US006645094B2

(12) United States Patent
Obidiegwu

(10) Patent No.: US 6,645,094 B2
(45) Date of Patent: Nov. 11, 2003

(54) TENNIS STROKE TRAINING APPARATUS

(76) Inventor: Joe Obidiegwu, 2900 Gordon Dr., Naples, FL (US) 34102

( * ) Notice: Subject to any disclaimer, the term of this patent is extended or adjusted under 35 U.S.C. 154(b) by 0 days.

(21) Appl. No.: 10/271,912

(22) Filed: Oct. 16, 2002

(65) Prior Publication Data

US 2003/0153411 A1 Aug. 14, 2003

Related U.S. Application Data

(60) Provisional application No. 60/356,358, filed on Feb. 13, 2002.

(51) Int. Cl.[7] ..... A63B 69/38
(52) U.S. Cl. ..... 473/461
(58) Field of Search ..... 473/461, 459, 473/474, 415, 422, 423, 257, 258, 260

(56) References Cited

U.S. PATENT DOCUMENTS

| | | | | |
|---|---|---|---|---|
| 3,503,611 A | | 3/1970 | McPherson | |
| 3,866,912 A | | 2/1975 | Scainetti | |
| 3,940,132 A | | 2/1976 | Lopatto, III | |
| 3,948,517 A | | 4/1976 | Feiler | |
| 4,003,572 A | | 1/1977 | Harvey | |
| 4,049,266 A | | 9/1977 | Feiler | |
| 4,089,521 A | | 5/1978 | Berst et al. | |
| 4,094,504 A | | 6/1978 | Barasch | |
| 4,105,204 A | | 8/1978 | Koenig | |
| 4,531,734 A | | 7/1985 | Herrick | |
| 6,056,653 A | * | 5/2000 | Boldin | 473/461 |
| 6,102,809 A | | 8/2000 | Nichols | |
| 6,390,930 B1 | * | 5/2002 | Gauer | 473/257 |
| 2001/0036874 A1 | | 11/2001 | Cathcart | |

* cited by examiner

*Primary Examiner*—Raleigh W. Chiu
(74) *Attorney, Agent, or Firm*—Allen D. Brufsky

(57) ABSTRACT

An athletic training device having a frame which is attached to a base at lower end and one or more guide rails at a higher end. Attached to the rails are one or more antennas which are resilient and flexible in nature. The rails preferably have a forward length which can be adjusted up or down which will corresponding shift the position of the attached antennas. The apparatus is used by starting a tennis game stroke at or near the rear length of the rails and progressively moving one's racquet progressively forward so as to impact the free ends of the antennas in the follow-through of the stroke. Because the rails and attached antennas can be adjusted in position, various stroke techniques can be practiced. Sensors are activated to show impact with the rails and a proper technique.

18 Claims, 3 Drawing Sheets

TENNIS STROKE TRAINING APPARATUS

This application claims the benefit of U.S. Provisional Application No. 60/356,358, filed Feb. 13, 2002.

BACKGROUND OF THE INVENTION

1. Field of the Invention

This invention relates to an athletic training apparatus, and more specifically relates to an apparatus for practicing correct strokes with a tennis racquet.

2. Description of the Prior Art

Some of the devices developed over the years for improving a tennis stroke are attached directly to the player. An exemplary garment is worn by a player having a shaft slightly wider than the shoulder width which includes indicators at each end to give the player a visual cue for proper shoulder rotation (U.S. Pat. No. 6,102,809).

Other apparatus developed for improving the stroke of players involve making modifications or attachments to the tennis racquet which is used to play the game. For example, there is disclosed a pouch which can be attached to a stringless tennis racquet used for catching a ball (U.S. Pat. No. 3,503,611), and a signaling device which is attached to a tennis racquet which includes a plurality of mechanical reed members, the longitudinal axes of which are disposed with respect to the tennis racquet as to be aligned with the stroke direction when a proper stroke is performed (U.S. Pat. No. 4,094,504). A distinct disadvantage of the aforementioned devices is that the user is unable to practice a stroke technique with the exact instrument used to play the game.

Still other devices for improving the stroke technique of players are those devices which are separate from the player as well as the instrument used to play the game. One of the earliest devices in the game of tennis is the backboard where an athlete hits a tennis ball toward a large, vertical wall, and the ball rebounds back to the player. Preferably, the wall will have a single, horizontal painted line to simulate the top of the net found in a tennis court. While the use of such a wall may be helpful for obtaining exercise and improving aim, basic tennis strokes cannot efficiently be practiced on such a device. Most players must direct their attention on running toward the ball and returning the same to the wall, and therefore have little time to concentrate on the actual stroke. The quick response necessary for practice against the wall increases the likelihood that the player will repeat bad habits which could irrevocably become engrained in the player's style. Additionally, such walls are typically located outdoors and consequently practice is impossible when inclement weather exists. Additionally, such walls are expensive to build and are subject to expensive maintenance particularly where the surface is wooded thereby requiring frequent repainting.

Other devices exist where a tennis ball or the like is attached to the upper end of a flexible arm, and the player swings a racquet or the like to impact the ball thereby causing the flexible arm to rotate away from the player. Typically such devices have a spring or other mechanism such that the arm can rotate back towards the player so that the ball can be repeatedly hit. Although such devices can simulate the resistance of a ball during actual play, such devices typically offer the player little guidance on how to maintain a proper stoke technique.

A still further type of tennis stroke training apparatus is disclosed in U.S. Pat. No. 4,105,204. The apparatus comprises a base having an upstanding member which receives a Z-shaped tube. The tube has a ball positioned on it whereby a user can place a stringless tennis racquet at the free end of the tube and practice his or her stroke by swinging the racquet throughout the length of the Z-shaped tube. Although the apparatus is useful in the sense that it offers more guidance on proper stroke technique than the typical hit-the-ball apparatus, it has the disadvantage that the user must use a stringless racquet.

Thus despite the variety of tennis stroke training devices developed over the years, there still exists a need for a device which is inexpensive to make, easy to assemble and which does not require the need for any specialized equipment to use.

SUMMARY OF THE INVENTION

In accordance with the invention, a tennis stroke training apparatus is provided having a frame which is attached to a base at the frame's lower end and to one or more guide rails at the frame's higher opposite end. Attached to the rails are one or more antennas which are resilient and flexible in nature. The rails preferably have a length which can be adjusted up or down which will correspondingly shift the position of the attached antennas.

The apparatus is used by starting a tennis stroke at or near the rear length of the rails and progressively moving one's racquet progressively forward so as to impact the free ends of the antennas in the follow-through of the stroke. Because the rails and attached antennas can be adjusted in position, various stroke techniques can be practiced.

The training apparatus optionally includes one or more sensors attached to one or more of the antennas. These sensors are activated when the antennas are impacted, giving the player an audible or visual cue that the stroke is being properly performed. In addition, the apparatus optionally includes a ball which is tethered to one of the antennas, preferably at a point of impact so that the player can also practice striking the ball.

In one separate embodiment, the training apparatus includes an overhead support having a mast and an arm. The free end of the arm is used to support a ball in the hanging position. The apparatus also optionally includes a spin-measuring device to measure the spin velocity of the ball when struck as well as a radar gun which can measure the racquet speed of the player.

DETAILED DESCRIPTION OF THE INVENTION

Figure 1:
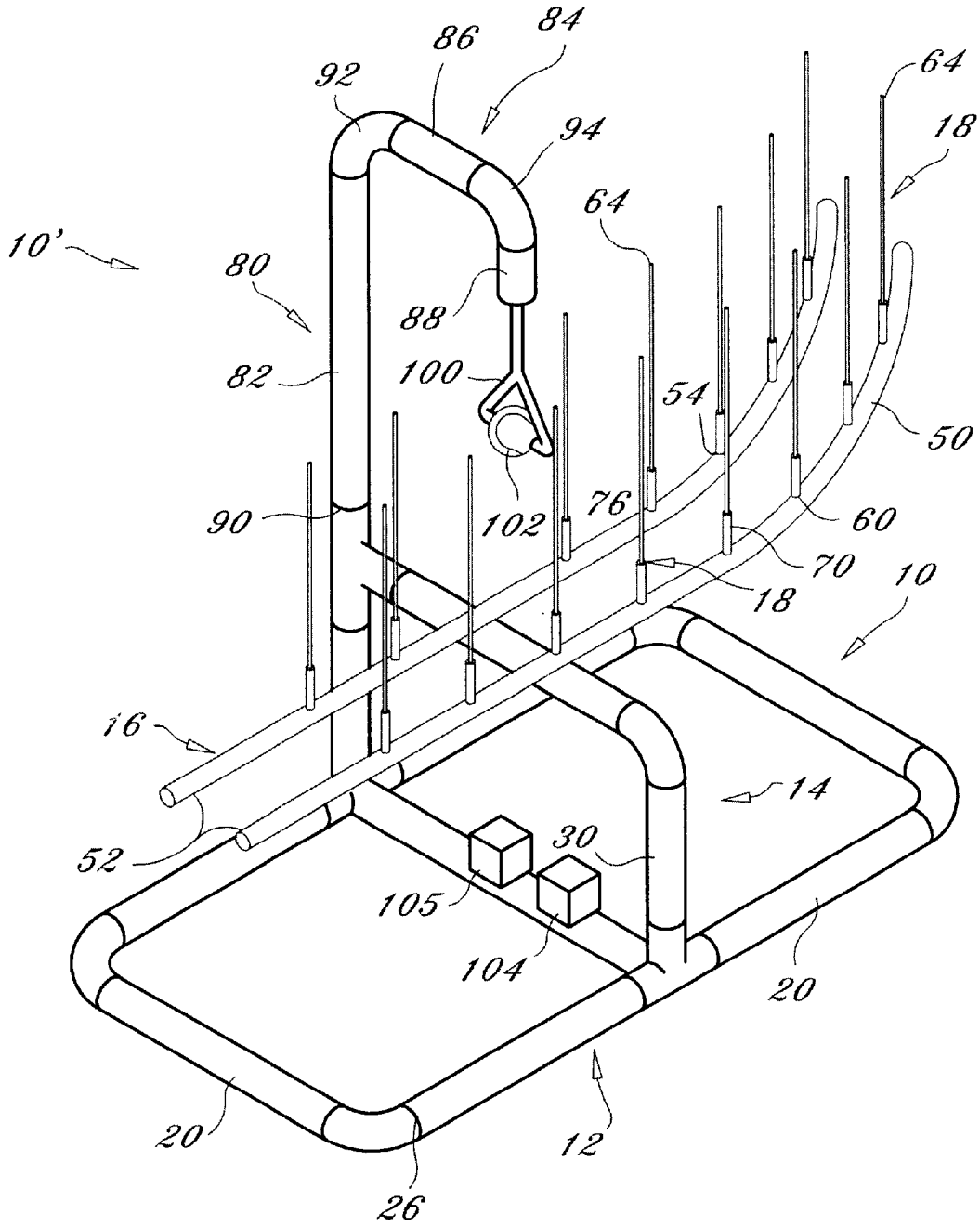
FIG. 1 is a perspective view of a schematic layout of the tennis stroke apparatus of the present invention.

Referring now to the drawings in detail, wherein like numerals indicate like elements throughout the several views, there is illustrated a stroke training apparatus generally designated as 10. Apparatus 10 includes a base 12, a frame 14, one or more guide rails 16, and one or more antennas 18.

In the particular embodiment shown in FIG. 1, base 12 includes a plurality of tubes 20 which are attached to each other at the ends 26 of each tube 20. In the embodiment shown base 12 is rectangular in shape but clearly any desired shape could be formed with the correct number of tubes 20 used.

The attachment of tubes 20 at ends 26 can be by any desired means but preferably the attachment is made by using elbows 28 and joints 29 as is shown in FIG. 1. One distinct advantage of the preferred embodiment shown is that tubes 20 can easily be assembled by inserting ends 26 of tubes 20 into elbows 28 and joints 29. Disassembly of tubes 20 can thereafter be easily accomplished simply by pulling out ends 26 of tubes 20 from elbows 28 or joints 29 as the case may be. As will be seen, a distinct advantage of the preferred embodiment of the entire apparatus 10 is that it can easily be easily dismantled and portably carried in a bag or some other similar carrying apparatus (not shown).

Frame 14 includes one or more tubular lower legs 30 which are attached to tubes 20 at one end through joints 29 and which are attached to crossbar tubes 36 at an opposing end through upper elbows 31. Crossbar tubes 36 are in turn attached to tubular upper legs 40 through upper joints 33.

Rails 16 of apparatus 10 are substantially similar in length as shown in FIG. 1 and include a forward length portion 50 and a rearward length portion 52. Forward length portion 50 is preferably resilient and can be flexibly adjusted upward or downward by sliding longitudinal movement through collars 57 on top of tubular leg 40 according to the stroke desired to be practiced. Rails 16 further include holes 54 on the top surface 56 of rails 16.

Antennas 18 of apparatus 10 include a first end 60 and a free end 64. Antennas 18 are attached to rails 16 by inserting the first end 60 of antennas 18 into holes 54 of rails 16. Although any other forms of attachment is contemplated by the current invention, a distinct advantage of the shown preferred embodiment is that antennas 18 can be easily both inserted and dismantled from rails 16 as the need may be. This is consistent with the desirability of the herein described preferred embodiment that apparatus 10 be capable of easy assembly, disassembly and portability.

Figure 2:
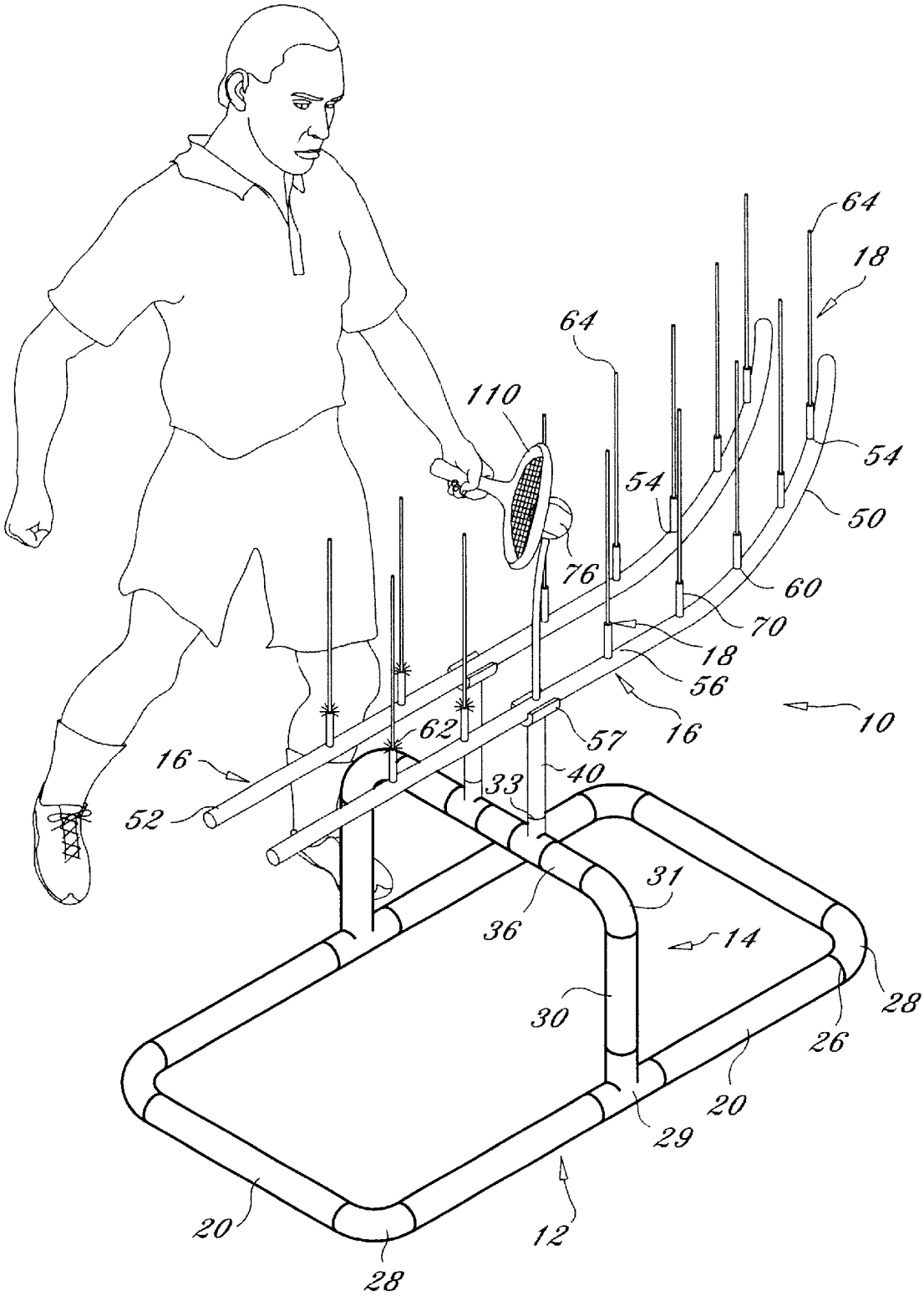
FIG. 2 is a right side perspective view of an embodiment of the tennis stroke training apparatus, showing how a tennis player would strike a ball which has been attached to the apparatus.

Antennas 18 are resilient and flexible in structure such that when struck with a tennis racquet, antennas 18 are able to bend forward and then return to their original forward position as is most clearly shown in FIG. 2.

Optionally attached to antennas 18 are one or more sensors 62 which can be used to give the player a visual or audible cue, as is well known in the art, that a proper stoke is being followed. For example, the sensor can be a switch-activated light which is activated upon impact with the antennas. Sensors are attached anywhere along the length of antennas, but preferably towards the first end 60 of antennas 18 which is attached to rails 16 as is most clearly shown in FIG. 3

An advantage of including one or more sensors is that the player will more easily perceive whether or not the proper stroke has been followed. As the racquet 110 touches antennas 18 sensors 62 will correspondingly become activated so that a visible light or sound is produced.

Figure 3:
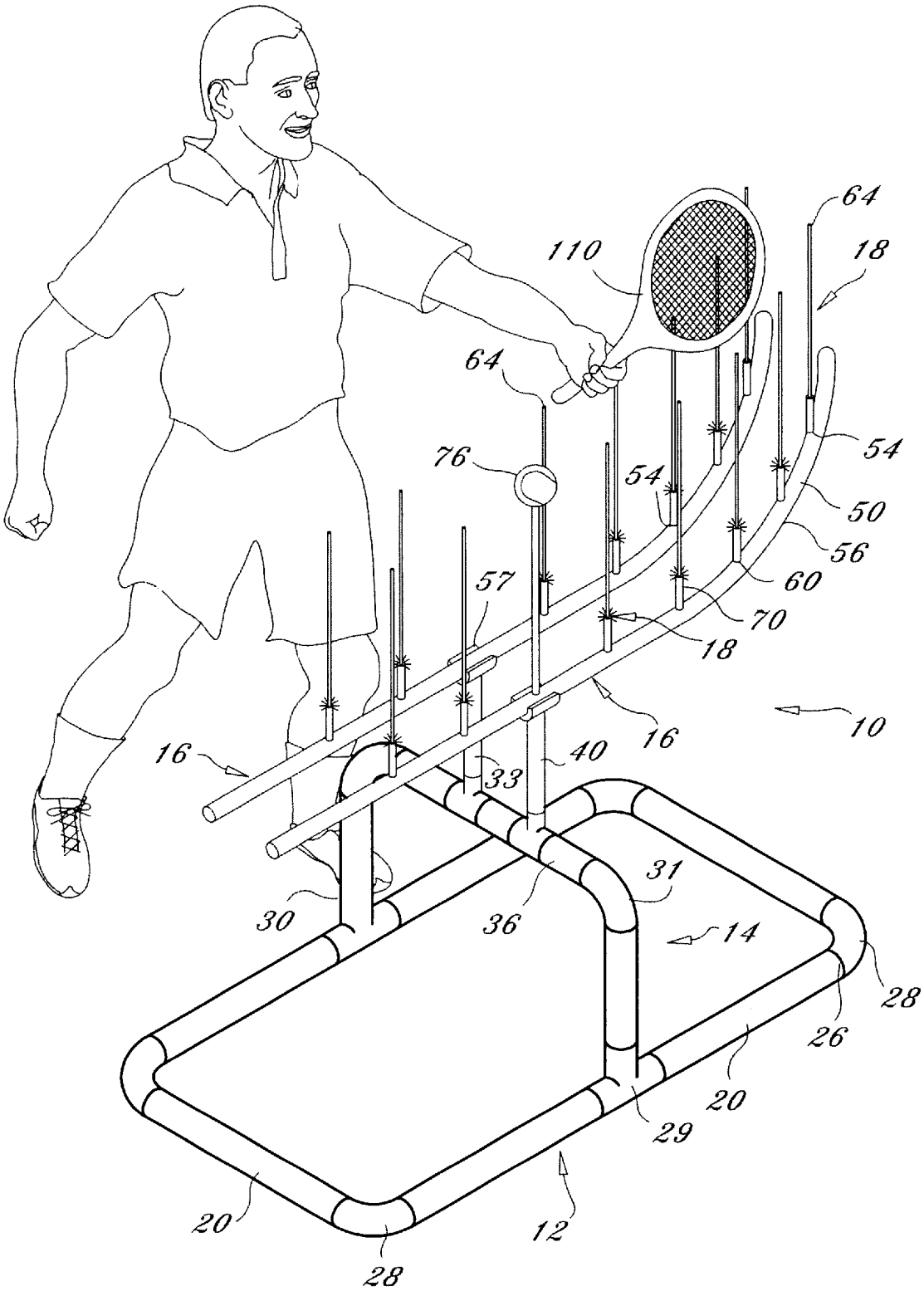
FIG. 3 is a view similar to FIG. 2 but shows the tennis player in the follow-through of a stroke.

The training apparatus 10 of the present invention optionally includes a ball 76 which is attached to the training apparatus 10, preferably to one of antennas 18 as is most clearly shown in FIGS. 2 and 3. Ball 76 can be tethered to antenna 18 either in a permanent manner so that when a player strikes ball 76 with a racquet 110, ball 76 remains on antenna 18. In the alternative, ball 76 can be attached to antenna 18 in a manner such as by seating or the like onto the free end 64 of antennas 18 such that when ball 76 is struck with a racquet 110, ball 76 is projected away from antennas 18.

The stroke training apparatus 10 can be fabricated from any desired material such as plastic, fiberglass, rubber, or lightweight metals such as aluminum. As is apparent, the same can be assembled without the use of special tools.

In operation, a player of the game of tennis, baseball or other sport will start his or her stroke at or near the rearward portion 52 of rails 16 and progressively move his or her racquet 110 forward in the follow-through of the stroke so as to just impact the free end 64 of antennas 18. The path which a proper follow-through stoke takes can easily be controlled simply by adjusting up or down the forward length portion 50 of rails 16 as is most clearly shown in FIG. 2 and FIG. 3. This adjustment is possible due to the flexible and resilient nature of the forward length portion 50 of rails 16. As an example in the game of tennis, the forward length portion 50 of rails 16 would be flexed upward for the practice of a topspin shot and lower for the practice of a passing or slice shot.

The stroke-training device 10 can be used equally well on the right or left-hand side. For executing backhand strokes in the game of tennis, for example, it is only necessary that the player reverse his or her position so that he or she stands on the opposite side of the training apparatus 10.

An optional feature of the training apparatus generally designated as 10' is shown in FIG. 1. Apparatus 10' includes an overhead support generally designated as 80 which is attached to apparatus 10 of the first preferred embodiment previously described.

Overhead support 80 of apparatus 10' includes a mast 82 and an arm 84. Arm 84 includes a horizontal extension 86 and a vertical extension 88.

One end 90 of mast 82 is attached to device 10, preferably at or near frame 14. The opposite end of mast 82 is attached to a first end of horizontal extension 86 at a point 92. The opposite end of horizontal extension 86 is attached to downward extension 88 at a point 94. Any means of attachment is contemplated, but preferably the attachment is detachable as by the use of elbows 28 at points 92 and 94. The opposite end 98 of downward extension 88 is attached to a Y shaped ball mount device 100 which is attached to ball 102. Preferably the attachment of ball mount device 100 to ball 102 is such that ball 102 is free to rotate when struck by a racquet or the like. Device 10' will optionally include a spin measuring device 104 which can measure the velocity of any spin when ball 102 is struck as well as a radar gun which can measure speed of a player's racquet 110.

The use and operation of apparatus 10' is much the same as with 10 of the first embodiment, except that by having ball 100 in an elevated state, the practice of additional types of strokes in the game of tennis is possible. Such strokes would include slices and volleys.

While this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications.

I claim:

1. A stroke training apparatus comprising:

(a) a base, (b) a frame which is attached to said base, (c) one or more guide rails slideably attached to said frame, and (d) one or more resilient antennas attached to said one or more rails, the forward length of said rails can be flexibly adjusted upward or downward according to the stroke desired to be practiced.

2. The stroke training apparatus in claim 1, wherein said attachment of said frame to said base, said rails to said frame, and said antennas to said rails is detachable.

3. The stroke training apparatus in claim 2, further comprising one or more sensors which are attached to said one or more antennas wherein when any one of said one or more antennas is impacted said one or more sensors attached to said any one of said one or more antennas is activated.

4. The stroke training apparatus in claim 3 wherein said activation results in the emission of a light or sound.

5. The stroke training apparatus in claim 4, further comprising a ball which is attached to a free end of said one or more antennas.

6. The stroke training apparatus in claim 1, further comprising one or more sensors which are attached to said one or more antennas wherein when any one of said one or more antennas is impacted said one or more sensors attached to said any one of said one or more antennas is activated.

7. The stroke training apparatus in claim 6 wherein said activation results in the emission of a light or sound.

8. The stroke training apparatus in claim 7 further comprising a ball which is attached to a free end of said one or more antennas.

9. A stroke training apparatus comprising:

(a) a base, (b) a frame comprising one or more lower legs which include a first end attached to said base and a second end which is attached to a support shaft, (c) one or more upper legs having a first end which is attached to said support shaft of said frame and a second end which is attached to one or more guide rails, and (d) one or more resilient antennas having a first end which is attached to said one or more rails wherein the forward length of said rails can be flexibly adjusted upward or downward according to the stroke desired to be practiced.

10. The stroke training apparatus in claim 9, wherein said attachment of said first end of said lower legs of said frame to said base, said second end of said lower legs to said support shaft, said first end of said upper legs to said support shaft, said second end of said upper legs to said rails, and said first end of said antennas to said rails are detachable.

11. The stroke training apparatus in claim 10, further comprising one or more sensors which are attached to said one or more antennas wherein when any one of said one or more antennas is impacted said one or more sensors attached to said any one of said one or more antennas is activated.

12. The stroke training apparatus in claim 11 wherein said activation results in the emission of a light or sound.

13. The stroke training apparatus in claim 12, further comprising a ball which is attached to a free end of said one or more antennas.

14. The stroke training apparatus in claim 9, further comprising one or more sensors which are attached to said one or more antennas wherein when any one of said one or more antennas is impacted said one or more sensors attached to said any one of said one or more antennas is activated.

15. The stroke training apparatus in claim 14 wherein said activation results in the emission of a light or sound.

16. The stroke training apparatus in claim 15, further comprising a ball which is attached to a free end of said one or more antennas.

17. A stroke training apparatus comprising:

(a) a base, (b) a frame comprising one or more lower legs which include a first end attached to said base and a second end which is attached to a support shaft, (c) one or more upper legs having a first end which is attached to said support shaft of said frame and a second end which is attached to one or more guide rails, said rails having a forward length which can be flexibly adjusted upward or downward, (d) one or more resilient antennas having a first end and a free end, said first end of said antennas being attached to said one or more rails, and (e) an overhead support having a mast and arm, said mask of said overhead support being attached to said frame of said apparatus at one end and attached at an opposite end to a first end of a horizontal extension of said arm, said horizontal extension of said arm being attached at its opposite second end to a downward extension of said arm, said downward extension having a free end which is attached to a ball, whereupon a stroke desired to be practiced can be practiced by hitting said ball and said free end of said antennas.

18. The stroke training device of claim 17, further comprising a radar gun and a ball spin velocity-measuring device.

* * * * *